US005972583A

United States Patent [19]

Bertucci et al.

[11] Patent Number: 5,972,583

[45] Date of Patent: Oct. 26, 1999

[54] PERIODATE PHOTOGRAPHIC BLEACHING COMPOSITIONS

[75] Inventors: Sidney J. Bertucci; Eric R. Schmittou, both of Rochester, N.Y.

[73] Assignee: Eastman Kodak Company, Rochester, N.Y.

[21] Appl. No.: 09/206,480

[22] Filed: Dec. 7, 1998

Related U.S. Application Data

[63] Continuation-in-part of application No. 08/947,072, Oct. 8, 1997.

[51] Int. Cl.[6] ..... G03C 7/42

[52] U.S. Cl. ..... 430/461; 430/460

[58] Field of Search ..... 430/461, 460

[56] References Cited

U.S. PATENT DOCUMENTS

| | | | |
|---|---|---|---|
| 3,960,565 | 6/1976 | Fisch et al. | 430/393 |
| 5,318,880 | 6/1994 | English et al. | 430/393 |
| 5,441,665 | 8/1995 | Massaioli | 510/169 |
| 5,460,924 | 10/1995 | Buchanan et al. | 430/393 |
| 5,464,728 | 11/1995 | Szajewski et al. | 430/393 |
| 5,508,151 | 4/1996 | O'Toole et al. | 430/393 |
| 5,521,056 | 5/1996 | Buchanan et al. | 430/430 |
| 5,607,820 | 3/1997 | Nakamura | 430/393 |
| 5,614,355 | 3/1997 | Haye et al. | 430/430 |
| 5,641,615 | 6/1997 | Haye et al. | 430/430 |
| 5,885,758 | 3/1999 | Bertucci et al. | 430/430 |

*Primary Examiner*—Hoa Van Le

*Attorney, Agent, or Firm*—J. Lanny Tucker

[57] ABSTRACT

Color photographic elements can be processed with an acidic periodate bleaching composition that also includes chloride ions as a rehalogenating agent.

5 Claims, No Drawings

PERIODATE PHOTOGRAPHIC BLEACHING COMPOSITIONS

RELATED APPLICATIONS

This is a CIP application of U.S. Ser. No. 08/947,072 filed Oct. 8, 1997, by Bertucci and Schmittou. It is also related to copending and commonly assigned U.S. Ser. No. 08/984,268, filed on even date herewith by Bertucci and Schmittou and entitled "Periodate Photographic Bleaching Methods."

FIELD OF THE INVENTION

The present invention relates generally to periodate photographic bleaching compositions useful in methods of processing color photographic elements.

BACKGROUND OF THE INVENTION

During processing of silver halide color photographic elements, the developed silver is oxidized to a silver salt by a suitable bleaching agent. The oxidized silver is then removed from the element in a fixing step.

The most common bleaching solutions are desirably acidic, and contain complexes of high valence metal ions, such as ferric ions, and various organic ligands. Both the metal ions and the chelating ligands present environmental concerns and are the subject of increasing regulatory scrutiny. Thus, a primary desire in this industry is to design bleaching compositions that are more compatible with the environment, with reduced use of high valent metal complex bleaching agents.

Bleaching solutions, such as those containing peroxide, or peracids such as persulfate, perborate, perphosphate, percarboxylic acid or percarbonate, as bleaching agents, offer an alternative to the ferric complex bleaching solutions. They are less expensive and present lower chemical and biological demands on the environment since their by-products can be less harmful. A number of such compositions have been explored, but to date they have not found wide acceptance in the trade for various reasons.

Various peroxide and peracid bleaching solutions are described, for example, in U.S. Pat. No. 5,318,880 (English et al), U.S. Pat. No. 5,464,728 (Szajewski et al), U.S. Pat. No. 5,508,151 (O'Toole et al) and U.S. Pat. No. 5,521,056 (Buchanan et al).

While persulfate bleaching agents have low environmental impact, they have the disadvantage that their bleaching activity is slow and thus require the presence of a special bleaching accelerator either in the processed material or in a processing bath (such as a bleach prebath) as taught by U.S. Pat. No. 5,318,880 (noted above). The most common bleaching accelerators have offensive odors.

Because hydrogen peroxide reacts and decomposes to form water, a peroxide based bleaching solution offers many environmental advantages over persulfate and ferric complex bleaching solutions. As a result, many publications describe peroxide bleaching solutions, including U.S. Pat. No. 4,277,556 (Koboshi et al), U.S. Pat. No. 4,301,236 (Idota et al), U.S. Pat. No. 4,454,224 (Brien et al), U.S. Pat. No. 4,717,649 (Hall et al), U.S. Pat. No. 5,550,009 (Haye et al), U.S. Pat. No. 5,541,041 (Haye), U.S. Pat. No. 5,641,615 (Haye et al), WO-A-92/01972 (published Feb. 6, 1992), WO-A-92/07300 (published Apr. 30, 1992) and EP 0 428 101A1 (published May 22, 1991). These compositions may comprise various amounts of chloride ions and have a pH in the range of 5 to 11.

Hydrogen peroxide bleaching compositions, however, often cause physical defects in the processed photographic elements, such as blistering (or vesiculation), and suffer long term stability problems at certain acidity levels. In addition, peroxide is ineffective in oxidizing developed silver to silver halide at highly acidic pH values, and thus it cannot be used to directly replace current high valent metal ligand bleaching solutions.

There is a desire and need in the photographic industry to find solutions to all of these problems. Thus, there is a need to avoid the use of bleaching accelerators and high valent metal bleaching agents while providing an effective acidic bleaching environment.

SUMMARY OF THE INVENTION

The problems noted above are overcome with a periodate bleaching composition having a pH of less than 7, and consisting essentially of periodate, or a source for providing periodate, at a concentration of from about 0.01 to about 0.35 mol/l, and chloride ions at a concentration of at least 0.01 mol/l.

The periodate bleaching compositions of this invention can replace the peroxide or peracid solutions known in the art, and in some cases, can shorten the bleaching time. For example, bleaching of silver chloride color photographic papers can be carried out in less than 15 seconds. Other elements may have similarly shortened bleaching steps.

A typical photographic bleaching composition contains an oxidant (that is, a bleaching agent), an agent to retain oxidized silver in the element being bleached (usually a halide ion), and a buffer. In bleaching compositions based on complexed high valent metal ions, persulfate or peroxide, a separate agent is needed to accomplish each of these functions. One advantage of the present invention is that periodate bleaching agents can simultaneously act as an oxidant (bleaching agent), silver retaining agent (rehalogenating agent) and buffer.

Unlike persulfate bleaching compositions, the periodate compositions of this invention do not require a bleaching accelerator to be effective. Particularly, the composition of the present invention contains no peracid bleaching accelerators as described in U.S. Pat. No. 5,318,880 (noted above) that are conventionally present in any composition used for or prior to bleaching, or in processable photographic elements.

Since the high valent metal complexes present environmental concerns, they are not purposely added to the bleaching compositions of this invention. Unlike peroxide bleaching compositions, the compositions of this invention easily convert developed silver to silver halide at acidic pH values (for example pH 1 to pH 4.5). No physical defects (such as blistering or vesiculation) are observed in the processed elements.

DETAILED DESCRIPTION OF THE INVENTION

The composition of this invention is used after color developing a silver halide color photographic element using any of the conventional color developing solutions known in the art. Such solutions typically include one or more color developing agents, antioxidants (or preservatives), sequestrants, halides, buffers, and other addenda that would be known in the art. Particularly useful color developing agents include aminophenols and p-phenylenediamines, and particularly useful antioxidants include substituted and unsubstituted hydroxylamines, hydrazines, hydrazides, sulfites, alpha-amino acids, mono- and polysaccharides, and alcoholamines. By substituted hydroxylamines is meant, for example, those having one or more alkyl or aryl groups connected to the nitrogen atom. These alkyl or aryl groups can be further substituted with one or more groups such as sulfo, carboxy, carbamoyl, sulfamoyl, hydroxy, alkoxy, and other groups known in the art which provide solubilizing effects. Examples of such hydroxylamines are described, for example, in U.S. Pat. No. 4,876,174 (Ishikawa et al), U.S. Pat. No. 4,892,804 (Vincent et al), U.S. Pat. No. 5,178,992 (Yoshida et al), U.S. Pat. No. 5,354,646 (Kobayashi et al), U.S. Pat. No. 5,508,155 (Marrese et al), and WO US96/03016 (Eastman Kodak).

Development can also be carried out using what is known in the art as a "developer/amplifier" solution, as described in U.S. Pat. No. 5,324,624 (Twist).

The amounts of the components of the color developing solution would be those considered conventional in the art. Further details of useful color developing solutions are provided in Research Disclosure, publication 38957, pages 591–639 (September 1996). Research Disclosure is a publication of Kenneth Mason Publications Ltd., Dudley House, 12 North Street, Emsworth, Hampshire PO10 7DQ England (also available from Emsworth Design Inc., 121 West 19th Street, New York, N.Y. 10011). This reference will be referred to herein as "Research Disclosure".

Following color development, the color photographic element is subjected to an acid treatment to stop color development. This can occur by contacting the element with an acidic solution having a pH of up to about 6, and preferably up to about 5. This solution can be simply a solution of one or more organic or inorganic acids that will suitably stop the activity of any color developing agent carried over from the color developing solution. Particularly useful acids include, but are not limited to, sulfuric acid, acetic acid, phosphoric acid, glycolic acid, maleic acid, propionic acid, nitric acid, methanesulfonic acid, citric acid, succinic acid, sulfosuccinic acid, phthalic acid and any other inorganic or organic acid that has a pKa less than about 5. Preferred acids are sulfuric acid, methanesulfonic acid, acetic acid, maleic acid and succinic acid. The amount of acid can vary depending upon the pH desired and the strength of a given acid, but would be readily ascertained by a skilled worker in the art. The acidic solution can also include a biocide, if desired.

Contact with the acidic solution is generally for up to about 60 seconds (although it could be longer), and preferably, from about 10 to about 45 seconds, and more preferably from about 10 to about 30 seconds. The temperature of the solution is generally from about 20 to about 50° C.

Following this step, the element is bleached using the periodate composition of this invention. These compositions contain one or more suitable sources of periodate as the sole essential component for the bleaching function. Such periodates include but not limited to hydrogen, alkali and alkaline earth salts, or a compound which releases or generates periodate. Alkali metal periodates, such as sodium periodate, are preferred bleaching agents.

Periodate exists in different forms in solution as a function of pH (see for example, Cotton and Wilkinson, Advanced Inorganic Chemistry, 2nd Edition, Interscience Publishers, New York, 1966, pp. 572–4), so that the form or forms of periodate that are the active bleaching agent(s) may vary as the bleaching composition pH varies. However, the most convenient sources of the active form(s) of the periodate bleaching agent for the preparation of bleaching compositions are the water-soluble salts of meta- and paraperiodic acids.

The amount of periodate (or a precursor that provides periodate) is generally at least 0.01 mol/l, preferably from about 0.01 to about 0.35 mol/l, and more preferably from about 0.05 to about 0.2 mol/l.

The periodate bleaching compositions also include chloride ions as a rehalogenating agent. This rehalogenating agent can be supplied as part of a simple inorganic salt for example, sodium chloride, potassium chloride, ammonium chloride or lithium chloride. In addition, it can be supplied as an organic salt such as a tetraalkylammonium chloride. The preferred salts are potassium and sodium chlorides. The concentration of chloride ions is generally from about 0.01 to about 1 mol/l.

While the periodate and chloride ions are the only components essential for bleaching, the bleaching compositions may also include one or more distinct phosphonic acid or carboxylic acid sequestering agents, buffers or corrosion inhibitors (such as nitrate ion) in conventional amounts.

The periodate bleaching composition is acidic, having a pH less than 7, preferably less than 6, and more preferably less than 5. Most preferably, the pH is from about 0.5 to about 5. The pH can be provided by adding a conventional weak or strong acid (such as sulfuric acid, acetic acid or phosphoric acid), and can be maintained by the presence of one or more suitable buffers having the requisite pKa, including, but not limited to, an acetate, a sulfate or a phosphate buffer. The amount of useful buffer or acid would be readily apparent to one skilled in the art. In addition, desired pH can be provided by the periodate itself.

The periodate bleaching compositions of this invention are completely free of any added complex of a high valent metal ion with any polycarboxylic acid, aminopolycarboxylic acid or phosphonic acid ligand. This does not mean that such complexes might not be carried out from prior processing solutions into the bleaching bath, but if this occurs, the maximum concentration should be less than $1\times10^{-2}$ mol/l, and preferably less than $1\times10^{-4}$ mol/l but clearly none of such complexes or both components to make such complexes, are purposely added to the compositions. Such carryover amounts are insufficient to perform the bleaching function. High valent metal ions are metal ions having a valence greater than +1, including iron(II), iron(III), copper (II), cobalt(II) and nickel(II).

Fixing of the processed element can be accomplished using any suitable fixing solution containing one or more suitable fixing agents. Representative fixing agents are described in Research Disclosure, noted above. Preferred fixing agents include thioethers, thiocyanates and thiosulfates. The components of the fixing solutions are present in conventional amounts.

The photographic elements processed using the present invention may be any suitable photographic color negative film, color reversal film, color paper, or motion picture films of all types. Each of these materials is processed using a periodate bleaching composition described herein in combination with the various conventional processing steps known in the art. The conditions, times and solutions used for processing the various elements are well known and readily ascertained by a skilled worker in the art.

The photographic elements can have any suitable combination of silver halide emulsion layers that are known in the art. The present invention is particularly useful to process photographic color papers, especially those having one or more predominantly silver chloride emulsions, meaning each emulsion has at least 50 mol % silver chloride. The other emulsions in the color paper can be the same or different, but preferably, all of the emulsions in the papers are predominantly silver chloride. Thus, the red, green and blue color records each have at least one predominantly silver chloride emulsion. More preferably, each emulsion has at least 90 mol % silver chloride, and most preferably, each emulsion has at least 95 mol % silver chloride. The predominantly silver chloride emulsions contain substantially no silver iodide, meaning less than 1 mol % of silver iodide. Any remaining silver halide in the emulsions is thus silver bromide.

The photographic emulsions used in these elements can have any suitable silver halide grain morphology including cubic, octahedral or tabular morphologies as described in numerous publications in the art, including Research Disclosure, noted above. Silver chloride emulsions can have tabular grains with {100} faces.

The photographic elements can be single or multilayer color elements. Multilayer color elements, such as multilayer color papers, are particularly suitable, and typically contain dye image-forming units sensitive to each of the three primary regions of the visible spectrum. Each unit can be comprised of a single emulsion layer or multiple emulsion layers sensitive to a given region of the spectrum. The layers of the element can be arranged in any of the various orders known in the art. In an alternative format, the emulsions sensitive to each of the three primary regions of the spectrum can be disposed as a single segmented layer. The elements can also contain other conventional layers such as filter layers, interlayers, subbing layers, overcoats and other layers readily apparent to one skilled in the art.

The multicolor photographic elements can advantageously have one or more appropriate cyan, yellow and magenta dye forming couplers in one or more silver halide emulsion layers. Various classes of such coupler compounds are known, as described in Research Disclosure noted above. Particularly useful magenta dye forming couplers include both two- and four-equivalent azole and pyrazole (especially two-equivalent pyrazolotriazole) couplers.

Considerably more details of the color photographic element structure and components are described in Research Disclosure, noted above. All types of emulsions can be used in the elements, including but not limited to, thin tabular grain emulsions, and either positive-working or negative-working emulsions, and the levels of silver coverage in the various types of elements can be any of those conventional in the industry. For example, the color papers used in this invention have low total silver coverage, that is up to about 1 g/m$^2$, and preferably up to about 0.75 g/m$^2$.

The elements are typically exposed to suitable radiation to form a latent image and then processed as described above to form a visible dye image. The fixing step described above can be followed by one or more washing and/or stabilizing steps, then drying to provide the desired image.

Processing can be carried out using conventional processing equipment, including what are known in the art as "low volume thin tank" processing systems having either rack and tank or automatic tray designs. Such processing methods and equipment are described, for example, in U.S. Pat. No. 5,436,118 (Carli et al) and publications noted therein.

Bleaching according to the present invention is generally carried out for at least 5 seconds, preferably at least 10 seconds, and more preferably at least 15 seconds. The maximum bleaching time will depend upon the type of element being processed. For example, silver chloride color papers can be bleached in less than about 30 seconds. The bleaching times for a given element could be determined with routine experimentation by a skilled photographic chemist.

Bleaching temperatures are generally from about 20 to about 50° C., and preferably from about 25 to about 45° C. Optimal bleaching temperatures can be readily determined for a given processed element with routine experimentation.

The following examples are presented to illustrate the practice of this invention, and are not intended to be limiting in any way. Unless otherwise indicated, all percentages are by weight.

Materials and Methods:

Unless otherwise indicated, the photographic elements processed in the examples were imagewise exposed for 0.1 second on a 1B sensitometer (3000K) through a 0–3 step chart and HA-50 and NP-11 filters. Unless otherwise indicated, the elements were processed using the various processing protocols at 35° C.

The residual silver for each of the 21 steps in the 0–3 chart was measured using conventional X-ray fluorescence (XRF). The measured values (g/m2) are shown in the various tables. In those tables, "DF" represents a photographic element that has been developed and then fixed only. It gives the level of silver developed in the photographic process. This is the level of silver that is to be bleached. "DBF" represents an element that has been developed, then bleached and fixed (full process). For a useful bleach, the silver levels in a DBF strip should be low, below about 0.040 g/m$^2$. "DB" represents an element that has been developed and bleached only (no fix). It is desirable for a bleach to be silver-retentive, that is, that all of the developed silver oxidized by the bleach should remain in the element until the fixing step. A bleach is silver retentive to the degree that the silver levels in the DB strip are similar at all exposure levels and on the order of the highest silver levels in the DF strip. "DBF-1" (Example 17) shows the residual silver in the element fully processed using the periodate bleaching composition of the invention, and "DBF-2" shows the residual silver in the element fully processed using the Color Film Bleaching Solution.

Some of the processing solutions used in the examples include:

Color Developer A

| | |
|---|---|
| Water | 700.0 ml |
| Triethanolamine | 12.41 g |
| PHORWITE REU | 2.30 g |
| Lithium polystyrene sulfonate (30% solution) | 0.30 g |
| N,N-diethylhydroxylamine (85% solution) | 5.40 g |
| Lithium sulfate | 2.70 g |
| KODAK Color Developing Agent CD-3 | 5.00 g |
| 1-Hydroxyethyl-1,1-diphosphonic acid (60% solution) | 1.16 g |
| Potassium carbonate, anhydrous | 21.16 g |
| Potassium bicarbonate | 2.79 g |
| Potassium bromide | 7.00 mg |
| Water to make 1.00 liter | |
| pH = 10.04 (at 27° C.) | |

Color Developer B

| | |
|---|---|
| Water | 800.00 ml |
| Potassium carbonate, anhydrous | 34.30 g |
| Potassium bicarbonate | 2.32 g |
| Sodium sulfite, anhydrous | 3.70 g |
| Potassium iodide | 1.20 mg |
| Sodium bromide | 1.31 g |
| Diethylenetriaminepentaacetic acid pentasodium salt (40% solution) | 8.43 g |
| Hydroxylamine sulfate | 2.41 g |
| KODAK Color Developing Agent CD-4 | 4.52 g |
| Water to make 1.00 liter | |
| pH = 10.00 (at27° C.) | |

-continued

| Fixing Solution A | |
|---|---|
| Sodium thiosulfate | 42.60 g |
| Sodium sulfite | 18.60 g |
| Glacial acetic acid | 10.00 ml |
| Disodium ethylenediaminetetraacetate | 1.00 g |
| Water to make 1.00 liter | |
| pH = 6.50 (at 25° C.) | |
| **Fixing Solution B** | |
| Water | 750.00 ml |
| Sodium sulfite | 10.00 g |
| Sodium thiosulfate | 240.00 g |
| Sodium metabisulfite | 25.00 g |
| Water to make 1.00 liter | |
| pH = 5.90 (at 22° C.) | |
| **Fixing Solution C** | |
| Ammonium thiosulfate | 145.0 g |
| Ammonium sulfite | 10.2 g |
| Sodium metabisulfite | 6.5 g |
| Ethylenediaminetetraacetic acid, tetrasodium salt, dihydrate | 1.7 g |
| Glacial acetic acid | 1.13 g |
| Water to make | 1 liter |
| pH = 6.5 (at 25° C.) | |
| **Color Paper Bleaching Solution** | |
| 1,3-Propanediaminetetraacetic acid (PDTA) | 15.40 g |
| Ferric nitrate, 9-hydrate | 18.30 g |
| Glacial acetic acid | 6.00 ml |
| 1,3-Diamino-2-propanoltetraacetic acid | 0.50 g |
| Potassium bromide | 23.90 g |
| Water to make 1.00 liter | |
| pH = 4.75 (at 25° C.) | |
| **Color Film Bleaching Solution** | |
| Ammonium bromide | 25.0 g |
| 1,3-Diaminopropanetetraacetic acid | 37.4 g |
| Ferric nitrate, 9-hydrate | 45.0 g |
| Aqueous ammonia (28%) | 70.0 ml |
| Glacial acetic acid | 80.0 ml |
| 1,3-Diamino-2-hydroxypropane- | 0.8 g |
| N,N,N',N'-tetraacetic acid | 0.8 g |
| Water to make | 1 liter |
| pH = 4.75 (at 25° C.) | |
| **Acid Stop Bath A** | |
| Water | 950.00 ml |
| Sulfuric acid (18 molar) | 10.00 ml |
| Water to make | 1.00 liter |
| **Acid Stop Bath B** | |
| Water | 950.00 ml |
| Glacial acetic acid | 9.00 ml |
| Water to make | 1.00 liter |

EXAMPLE 1

This example shows that a periodate based bleaching composition is effective while comparable bleaching solutions in which the periodate bleaching agent is replaced (on an equimolar basis) by persulfate or hydrogen peroxide are not effective, even when the time allowed for bleaching with the latter two solutions is three times that used with the periodate composition. All processing solutions used in the method of this invention as practiced in this example were free of peracid bleaching accelerators and ferric ion complexes.

KODAK EDGE Color Paper was exposed and processed according to the following processing protocol. This color paper contained no bleaching accelerators.

| | Time (sec) | | | |
|---|---|---|---|---|
| Solution | DF | DBF | | DB |
| Color Developer A | 45 | 45 | 45 | 45 |
| Stop Bath A | 30 | 30 | 30 | 30 |
| Water wash | 30 | 30 | 30 | 30 |
| Bleach A,B or C | — | 30 | 90 | 90 |
| Water wash | 150 | 120 | 60 | 60 |
| Fixing Solution A | 60 | 60 | 60 | — |
| Water wash | 90 | 90 | 90 | 150 |

The bleaching compositions comprised the following formulations:

| Bleaching Composition A (Invention) | |
|---|---|
| Sodium periodate | 21.4 grams |
| Sodium chloride | 2.92 grams |
| Sodium acetate, trihydrate | 3.16 grams |
| Glacial acetic acid | 1.61 grams |
| Water to make | 1 liter |
| pH = 4.5 | |
| **Bleaching Composition B (Comparison)** | |
| Hydrogen peroxide (30 wt % in water) | 11.3 grams |
| Sodium chloride | 2.92 grams |
| Sodium acetate, trihydrate | 3.16 grams |
| Glacial acetic acid | 1.61 grams |
| Water to make | 1 liter |
| pH = 4.5 | |
| **Bleaching Composition C (Comparison)** | |
| Sodium persulfate | 23.8 grams |
| Sodium chloride | 2.92 grams |
| Sodium acetate, trihydrate | 3.16 grams |
| Glacial acetic acid | 1.61 grams |
| Water to make | 1 liter |
| pH = 4.5 | |

The residual silver values are shown below in Table I for Bleaching Composition A (after 30 seconds of bleaching), in Table II for Bleaching Composition B (after 90 seconds of bleaching), and in Table III for Bleaching Composition C (after 90 seconds of bleaching).

TABLE I

| DF | DBF | DB |
|---|---|---|
| 0.588 | 0.002 | 0.680 |
| 0.613 | 0.010 | 0.648 |
| 0.600 | 0.003 | 0.690 |
| 0.587 | 0.002 | 0.672 |
| 0.573 | 0.006 | 0.676 |
| 0.569 | 0.004 | 0.649 |
| 0.531 | 0.005 | 0.668 |
| 0.491 | 0.009 | 0.677 |
| 0.424 | 0.019 | 0.673 |
| 0.361 | 0.006 | 0.654 |
| 0.221 | 0.000 | 0.664 |
| 0.115 | 0.006 | 0.664 |
| 0.054 | 0.000 | 0.684 |
| 0.031 | 0.019 | 0.651 |
| 0.001 | 0.003 | 0.653 |
| 0.008 | 0.005 | 0.651 |
| 0.001 | 0.012 | 0.669 |
| 0.014 | 0.009 | 0.658 |
| 0.000 | 0.009 | 0.656 |
| 0.006 | 0.000 | 0.690 |
| 0.000 | 0.000 | 0.676 |

TABLE II

| DF | DBF | DB |
|---|---|---|
| 0.642 | 0.608 | 0.673 |
| 0.634 | 0.626 | 0.668 |
| 0.625 | 0.578 | 0.657 |
| 0.630 | 0.584 | 0.663 |
| 0.630 | 0.577 | 0.685 |
| 0.594 | 0.557 | 0.665 |
| 0.574 | 0.509 | 0.654 |
| 0.525 | 0.500 | 0.669 |
| 0.470 | 0.416 | 0.668 |
| 0.355 | 0.329 | 0.677 |
| 0.242 | 0.230 | 0.652 |
| 0.126 | 0.123 | 0.651 |
| 0.058 | 0.954 | 0.667 |
| 0.020 | 0.012 | 0.653 |
| 0.006 | 0.000 | 0.652 |
| 0.010 | 0.014 | 0.656 |
| 0.000 | 0.002 | 0.680 |
| 0.014 | 0.000 | 0.677 |
| 0.005 | 0.002 | 0.668 |
| 0.002 | 0.010 | 0.653 |
| 0.000 | 0.003 | 0.672 |

TABLE III

| DF | DBF | DB |
|---|---|---|
| 0.636 | 0.618 | 0.667 |
| 0.649 | 0.608 | 0.656 |
| 0.623 | 0.626 | 0.683 |
| 0.649 | 0.615 | 0.650 |
| 0.612 | 0.624 | 0.668 |
| 0.596 | 0.595 | 0.659 |
| 0.562 | 0.557 | 0.667 |
| 0.528 | 0.533 | 0.683 |
| 0.455 | 0.450 | 0.659 |
| 0.381 | 0.380 | 0.680 |
| 0.237 | 0.253 | 0.672 |
| 0.143 | 0.132 | 0.675 |
| 0.055 | 0.048 | 0.649 |
| 0.016 | 0.017 | 0.667 |
| 0.020 | 0.000 | 0.675 |
| 0.006 | 0.000 | 0.675 |
| 0.004 | 0.000 | 0.665 |
| 0.000 | 0.006 | 0.668 |
| 0.000 | 0.014 | 0.676 |

EXAMPLE 2

This example was carried out similarly to Example 1. It shows that a periodate bleaching composition is useful even at low bleaching agent concentration. KODAK EDGE Color Paper was exposed and processed using the following processing protocol:

| | Time (min) | | |
|---|---|---|---|
| Solution | DF | DBF | DB |
| Color Developer A | 1 | 1 | 1 |
| Water rinse* | — | — | — |
| Stop Bath A | 1 | 1 | 1 |
| Water wash | 1 | 1 | 1 |
| Bleach D | — | 3 | 3 |
| Water wash | 5 | 2 | 2 |
| Fixing Solution B | 3 | 3 | — |
| Water wash | 3 | 3 | 6 |

*Less than 2 seconds

-continued

| Bleaching Composition D | |
|---|---|
| Sodium periodate | 5.35 grams |
| Sodium chloride | 0.58 grams |
| Water to make | 1 liter |
| pH = 4.6 | |

The residual silver values are shown below in TABLE IV.

TABLE IV

| DF | DBF | DB |
|---|---|---|
| 0.536 | 0.004 | 0.641 |
| 0.618 | 0.005 | 0.627 |
| 0.607 | 0.004 | 0.615 |
| 0.594 | 0.000 | 0.624 |
| 0.536 | 0.000 | 0.656 |
| 0.533 | 0.000 | 0.627 |
| 0.547 | 0.000 | 0.639 |
| 0.559 | 0.000 | 0.635 |
| 0.482 | 0.000 | 0.637 |
| 0.413 | 0.005 | 0.614 |
| 0.293 | 0.000 | 0.640 |
| 0.156 | 0.000 | 0.625 |
| 0.067 | 0.001 | 0.625 |
| 0.027 | 0.000 | 0.634 |
| 0.014 | 0.004 | 0.623 |
| 0.000 | 0.003 | 0.644 |
| 0.000 | 0.000 | 0.637 |
| 0.002 | 0.001 | 0.622 |
| 0.000 | 0.000 | 0.639 |
| 0.000 | 0.002 | 0.629 |
| 0.000 | 0.008 | 0.643 |

EXAMPLE 3

This example demonstrates the usefulness of the present invention at high periodate concentrations. KODAK EDGE Color Paper was exposed and processed according to the following protocol:

| | Time (sec) | | |
|---|---|---|---|
| Solution | DF | DBF | DB |
| Color Developer A | 45 | 45 | 45 |
| Stop Bath A | 45 | 45 | 45 |
| Water wash | 60 | 60 | 60 |
| Bleach E | — | 45 | 45 |
| Water wash | 105 | 60 | 60 |
| Fixing Solution B | 60 | 60 | — |
| Water wash | 90 | 90 | 150 |

| Bleaching Composition E | |
|---|---|
| Sodium periodate | 72.8 grams |
| Sodium chloride | 2.92 grams |
| Water to make | 1 liter |
| pH = 4.1 | |

The residual silver values are shown below in TABLE V.

TABLE V

| DF | DBF | DB |
|---|---|---|
| 0.638 | 0.004 | 0.676 |
| 0.640 | 0.018 | 0.676 |
| 0.630 | 0.016 | 0.667 |
| 0.662 | 0.011 | 0.692 |
| 0.656 | 0.012 | 0.673 |

TABLE V-continued

| DF | DBF | DB |
|---|---|---|
| 0.618 | 0.016 | 0.664 |
| 0.591 | 0.016 | 0.682 |
| 0.565 | 0.000 | 0.653 |
| 0.473 | 0.000 | 0.665 |
| 0.388 | 0.001 | 0.655 |
| 0.247 | 0.000 | 0.701 |
| 0.134 | 6.002 | 0.656 |
| 0.072 | 0.014 | 0.655 |
| 0.024 | 0.010 | 0.646 |
| 0.010 | 0.012 | 0.657 |
| 0.013 | 0.009 | 0.662 |
| 0.014 | 0.000 | 0.668 |
| 0.011 | 0.006 | 0.667 |
| 0.011 | 0.000 | 0.658 |
| 0.001 | 0.000 | 0.678 |
| 0.010 | 0.002 | 0.647 |

EXAMPLE 4

This example shows rapid bleaching at a periodate level between that of Examples 2 and 3. KODAK EDGE Color Paper was exposed and processed according to the following processing protocol:

| | Time (sec) | | |
|---|---|---|---|
| Solution | DF | DBF | DB |
| Color Developer A | 45 | 45 | 45 |
| Step Bath A | 45 | 45 | 45 |
| Water wash | 60 | 60 | 60 |
| Bleach F | — | 30 | 30 |
| Water wash | 90 | 60 | 60 |
| Fixing Solution B | 60 | 60 | — |
| Water wash | 90 | 90 | 150 |

| Bleaching Composition F | |
|---|---|
| Sodium periodate | 10.7 grams |
| Sodium chloride | 2.92 grams |
| Water to make | 1 liter |
| pH = 4.6 | |

The residual silver values are shown below in TABLE VI.

TABLE VI

| DF | DBF | DB |
|---|---|---|
| 0.639 | 0.029 | 0.627 |
| 0.644 | 0.000 | 0.632 |
| 0.647 | 0.012 | 0.637 |
| 0.616 | 0.011 | 0.641 |
| 0.609 | 0.009 | 0.641 |
| 0.604 | 0.000 | 0.637 |
| 0.616 | 0.000 | 0.641 |
| 0.583 | 0.004 | 0.635 |
| 0.505 | 0.005 | 0.637 |
| 0.380 | 0.000 | 0.655 |
| 0.272 | 0.000 | 0.638 |
| 0.129 | 0.003 | 0.656 |
| 0.057 | 0.000 | 0.658 |
| 0.027 | 0.003 | 0.642 |
| 0.002 | 0.000 | 0.637 |
| 0.017 | 0.000 | 0.646 |
| 0.000 | 0.000 | 0.633 |
| 0.012 | 0.000 | 0.662 |
| 0.002 | 0.011 | 0.638 |
| 0.000 | 0.000 | 0.640 |
| 0.000 | 0.000 | 0.649 |

EXAMPLE 5

This example demonstrates the use of a buffered periodate bleaching composition to provide extremely rapid bleaching of silver developed color photographic paper. KODAK EDGE Color Paper was exposed and processed according to the processing protocol described in Example 4 except that Bleaching Composition F was replaced with Bleaching Composition A and the bleaching time was reduced to 15 seconds. The residual silver values are shown below in TABLE VII.

TABLE VII

| DF | DBF | DB |
|---|---|---|
| 0.649 | 0.003 | 0.636 |
| 0.657 | 0.000 | 0.665 |
| 0.618 | 0.006 | 0.655 |
| 0.625 | 0.999 | 0.655 |
| 0.628 | 0.001 | 0.643 |
| 0.593 | 0.006 | 0.659 |
| 0.576 | 0.000 | 0.635 |
| 0.553 | 0.015 | 0.677 |
| 0.488 | 0.019 | 0.640 |
| 0.396 | 0.003 | 0.642 |
| 0.253 | 0.013 | 0.650 |
| 0.136 | 0.000 | 0.653 |
| 0.055 | 0.008 | 0.651 |
| 0.019 | 0.000 | 0.655 |
| 0.014 | 0.006 | 0.623 |
| 0.006 | 0.005 | 0.643 |
| 0.008 | 0.013 | 0.655 |
| 0.011 | 0.003 | 0.658 |
| 0.000 | 0.002 | 0.653 |
| 0.003 | 0.003 | 0.642 |
| 0.000 | 0.000 | 0.625 |

EXAMPLE 6

This example demonstrates bleaching of KODAK EKTAMAX Paper using a periodate bleaching composition that was buffered at low pH. The paper samples were similarly exposed as in preceding examples except the exposure time was 0.2 seconds, and processed according to the following processing protocol. All processing solutions used in the method of this invention as practiced in this example were free of peracid bleaching accelerators and ferric ion complexes. The KODAK EKTAMAX Paper contained no bleaching accelerators.

| | Time (sec) | |
|---|---|---|
| Solution | DF | DBF |
| Color Developer A | 45 | 45 |
| Stop Bath A | 30 | 30 |
| Water wash | 30 | 30 |
| Bleach G | — | 30 |
| Water wash | 90 | 60 |
| Fixing Solution A | 60 | 60 |
| Water wash | 90 | 90 |

| Bleaching Composition G | |
|---|---|
| Sodium periodate | 16.1 grams |
| Sodium chloride | 11.7 grams |
| Sodium phosphate, monobasic, monohydrate | 17.3 grams |
| Phosphoric acid (85% in water) | 14.4 grams |
| Water to make | 1 liter |
| pH = 1.95 | |

The residual silver values are shown below in TABLE VIII.

TABLE VII

| DF | DBF |
|---|---|
| 0.566 | 0.002 |
| 0.551 | 0.000 |
| 0.590 | 0.001 |
| 0.552 | 0.003 |
| 0.539 | 0.000 |
| 0.526 | 0.006 |
| 0.493 | 0.000 |
| 0.466 | 0.000 |
| 0.420 | 0.000 |
| 0.352 | 0.004 |
| 0.273 | 0.004 |
| 0.180 | 0.000 |
| 0.090 | 0.003 |
| 0.039 | 0.011 |
| 0.008 | 0.000 |
| 0.004 | 0.011 |
| 0.016 | 0.005 |
| 0.600 | 0.000 |
| 0.003 | 0.003 |
| 0.000 | 0.005 |
| 0.000 | 0.000 |

EXAMPLE 7

This example demonstrates bleaching of KODAK PORTRA III Color Paper with a periodate composition that is buffered at low pH. The color paper was exposed and processed as in Example 6. The residual silver values are shown below in TABLE IX. All processing solutions used in the method of this invention as practiced in this example were free of peracid bleaching accelerators and ferric ion complexes. The KODAK PORTRA III Color Paper contained no bleaching accelerators.

TABLE IX

| DF | DBF |
|---|---|
| 0.593 | 0.000 |
| 0.599 | 0.009 |
| 0.584 | 0.000 |
| 0.569 | 0.004 |
| 0.583 | 0.000 |
| 0.582 | 0.012 |
| 0.542 | 0.000 |
| 0.520 | 0.000 |
| 0.483 | 0.001 |
| 0.414 | 0.003 |
| 0.321 | 0.003 |
| 0.249 | 0.000 |
| 0.155 | 0.008 |
| 0.085 | 0.000 |
| 0.047 | 0.014 |
| 0.017 | 0.006 |
| 0.000 | 0.000 |
| 0.004 | 0.000 |
| 0.012 | 0.001 |
| 0.000 | 0.000 |
| 0.002 | 0.000 |

EXAMPLE 8

This example demonstrates bleaching of commercially available FUJICOLOR SUPER FA 5 Color Paper using a periodate bleaching composition that was buffered at low pH. The samples of the color paper were exposed and processed as in Example 6. The residual silver values are shown below in TABLE X. All processing solutions used in the method of this invention as practiced in this example were free of peracid bleaching accelerators and ferric ion complexes.

TABLE X

| DF | DBF |
|---|---|
| 0.495 | 0.000 |
| 0.057 | 0.000 |
| 0.497 | 0.000 |
| 0.513 | 0.001 |
| 0.512 | 0.000 |
| 0.503 | 0.000 |
| 0.503 | 0.000 |
| 0.499 | 0.004 |
| 0.487 | 0.000 |
| 0.465 | 0.000 |
| 0.412 | 0.004 |
| 0.353 | 0.000 |
| 0.251 | 0.008 |
| 0.143 | 0.008 |
| 0.083 | 0.000 |
| 0.026 | 0.008 |
| 0.024 | 0.002 |
| 0.015 | 0.000 |
| 0.000 | 0.002 |
| 0.000 | 0.000 |
| 0.005 | 0.000 |

EXAMPLE 9

This example demonstrates bleaching of commercially available KONICACOLOR QA TYPE A6E Color Paper using a periodate bleaching composition that was buffered at low pH. The color paper samples were exposed and processed as in Example 6. The residual silver values are shown below in TABLE XI. All processing solutions used in the method of this invention as practiced in this example were free of peracid bleaching accelerators and ferric ion complexes.

TABLE XI

| DF | DBF |
|---|---|
| 0.497 | 0.600 |
| 0.478 | 0.004 |
| 0.481 | 0.000 |
| 0.457 | 0.000 |
| 0.454 | 0.000 |
| 0.464 | 0.003 |
| 0.429 | 0.000 |
| 0.432 | 0.000 |
| 0.424 | 0.008 |
| 0.407 | 0.002 |
| 0.344 | 0.000 |
| 0.279 | 0.000 |
| 0.161 | 0.000 |
| 0.071 | 0.000 |
| 0.029 | 0.000 |
| 0.003 | 0.008 |
| 0.000 | 0.000 |
| 0.000 | 0.000 |
| 0.000 | 0.000 |
| 0.000 | 0.002 |
| 0.000 | 0.000 |

EXAMPLE 10

This example demonstrates bleaching of KODAK EDGE 5 Color Paper with a periodate composition that was buffered at low pH. The samples of color paper were exposed and processed as in Example 6. The residual silver values are shown in TABLE XII. All processing solutions used in the method of this invention as practiced in this example were free of peracid bleaching accelerators and ferric ion complexes. The KODAK EDGE 5 Color Paper contained no bleaching accelerators.

TABLE XII

| DF | DBF |
|---|---|
| 0.618 | 0.000 |
| 0.614 | 0.013 |
| 0.597 | 0.003 |
| 0.604 | 0.000 |
| 0.581 | 0.003 |
| 0.579 | 0.000 |
| 0.576 | 0.003 |
| 0.549 | 0.000 |
| 0.500 | 0.013 |
| 0.480 | 0.000 |
| 0.416 | 0.000 |
| 0.335 | 0.009 |
| 0.221 | 0.011 |
| 0.122 | 0.009 |
| 0.063 | 0.000 |
| 0.012 | 0.002 |
| 0.012 | 0.006 |
| 0.000 | 0.003 |
| 0.000 | 0.003 |
| 0.004 | 0.000 |
| 0.013 | 0.000 |

EXAMPLE 11

This example demonstrates bleaching of KODAK ULTRA II Color Paper with a periodate composition that was buffered at low pH. The color paper samples were exposed and processed as in Example 6. The residual silver values are shown below in TABLE XIII. All processing solutions used in the method of this invention as practiced in this example were free of peracid bleaching accelerators and ferric ion complexes. The KODAK ULTRA II Color Paper contained no bleaching accelerators.

TABLE XIII

| DF | DBF |
|---|---|
| 0.782 | 0.006 |
| 0.762 | 0.004 |
| 0.777 | 0.001 |
| 0.780 | 0.000 |
| 0.777 | 0.000 |
| 0.747 | 0.003 |
| 0.738 | 0.000 |
| 0.713 | 0.002 |
| 0.647 | 0.002 |
| 0.559 | 0.000 |
| 0.458 | 0.000 |
| 0.339 | 0.000 |
| 0.217 | 0.011 |
| 0.127 | 0.010 |
| 0.057 | 0.000 |
| 0.026 | 0.006 |
| 0.005 | 0.006 |
| 0.005 | 0.000 |
| 0.006 | 0.017 |
| 0.000 | 0.014 |
| 0.003 | 0.001 |

EXAMPLE 12

This example demonstrates bleaching of KODAK SUPRA II Color Paper using a periodate composition that was buffered at low pH. The color paper samples were exposed and processed as in Example 6. The residual silver values are shown below in TABLE XIV. All processing solutions used in the method of this invention as practiced in this example were free of peracid bleaching accelerators and ferric ion complexes. The KODAK SUPRA II Color Paper contained no bleaching accelerators.

TABLE XIV

| DF | DBF |
|---|---|
| 0.744 | 0.000 |
| 0.736 | 0.000 |
| 0.746 | 0.000 |
| 0.728 | 0.000 |
| 0.734 | 0.000 |
| 0.707 | 0.000 |
| 0.695 | 0.000 |
| 0.670 | 0.000 |
| 0.627 | 0.003 |
| 0.556 | 0.000 |
| 0.446 | 0.000 |
| 0.329 | 0.000 |
| 0.184 | 0.000 |
| 0.090 | 0.000 |
| 0.026 | 0.002 |
| 0.012 | 0.002 |
| 0.000 | 0.000 |
| 0.000 | 0.005 |
| 0.000 | 0.006 |
| 0.000 | 0.000 |
| 0.000 | 0.004 |

EXAMPLE 13

This example demonstrates bleaching of commercially available AGFACOLOR TYPE 10 Color Paper with a periodate bleaching composition that was buffered at low pH. The color paper samples were exposed and processed as in Example 6. The residual silver values are shown below in TABLE XV. All processing solutions used in the method of this invention as practiced in this example were free of peracid bleaching accelerators and ferric ion complexes.

TABLE XV

| DF | DBF |
|---|---|
| 0.667 | 0.002 |
| 0.639 | 0.000 |
| 0.643 | 0.005 |
| 0.641 | 0.000 |
| 0.642 | 0.001 |
| 0.634 | 0.012 |
| 0.647 | 0.002 |
| 0.622 | 0.000 |
| 0.581 | 0.004 |
| 0.534 | 0.000 |
| 0.446 | 0.005 |
| 0.332 | 0.000 |
| 0.197 | 0.002 |
| 0.120 | 0.000 |
| 0.034 | 0.017 |
| 0.014 | 0.000 |
| 0.000 | 0.015 |
| 0.009 | 0.003 |
| 0.014 | 0.015 |
| 0.000 | 0.000 |
| 0.009 | 0.000 |

EXAMPLE 14

This example demonstrates bleaching of KODAK DURAFLEX RA display material using a periodate composition that was buffered at low pH. The display material was exposed as in Example 6 and processed according to the following processing protocol. All processing solutions used in the method of this invention as practiced in this example were free of peracid bleaching accelerators and ferric ion complexes. The display material contained no bleaching accelerators.

| Solution | Time (sec) DF | DBF |
|---|---|---|
| Color Developer A | 110 | 110 |
| Stop Bath A | 60 | 60 |
| Water wash | 60 | 60 |
| Bleach G | — | 60 |
| Water wash | 120 | 60 |
| Fixing Solution A | 150 | 150 |
| Water wash | 90 | 90 |

The residual silver values are shown below in TABLE XVI.

TABLE XVI

| DF | DBF |
|---|---|
| 0.964 | 0.002 |
| 0.940 | 0.013 |
| 0.930 | 0.000 |
| 0.952 | 0.000 |
| 0.928 | 0.000 |
| 0.900 | 0.011 |
| 0.932 | 0.005 |
| 0.918 | 0.001 |
| 0.878 | 0.000 |
| 0.809 | 0.002 |
| 0.703 | 0.006 |
| 0.558 | 0.000 |
| 0.426 | 0.008 |
| 0.258 | 0.000 |
| 0.140 | 0.000 |
| 0.059 | 0.009 |
| 0.027 | 0.000 |
| 0.000 | 0.004 |
| 0.011 | 0.001 |
| 0.000 | 0.000 |
| 0.005 | 0.000 |

EXAMPLE 15

This example demonstrates bleaching of KODAK DURATRANS RA display material using a periodate bleaching composition that was buffered at low pH. The display material was exposed and processed as in Example 14. The residual silver values are shown below in TABLE XVII. All processing solutions used in the method of this invention as practiced in this example were free of peracid bleaching accelerators and ferric ion complexes. The display material contained no bleaching accelerators.

TABLE XVII

| DF | DBF |
|---|---|
| 1.639 | 0.006 |
| 1.655 | 0.000 |
| 1.643 | 0.005 |
| 1.673 | 0.000 |
| 1.625 | 0.012 |
| 1.597 | 0.013 |
| 1.520 | 0.006 |
| 1.382 | 0.000 |
| 1.223 | 0.000 |
| 0.985 | 0.000 |

TABLE XVII-continued

| DF | DBF |
|---|---|
| 0.776 | 0.000 |
| 0.568 | 0.003 |
| 0.360 | 0.000 |
| 0.216 | 0.005 |
| 0.098 | 0.003 |
| 0.049 | 0.008 |
| 0.026 | 0.000 |
| 0.008 | 0.011 |
| 0.008 | 0.000 |
| 0.000 | 0.000 |
| 0.000 | 0.000 |

EXAMPLE 16

This example demonstrates bleaching of KODAK DURACLEAR RA display material using a periodate bleaching composition that was buffered at low pH. This example demonstrates that this periodate composition can bleach high levels of developed silver. The display material was exposed as in Example 6 except that the exposure time was 0.5 seconds. Processing was as in Example 14. The residual silver values are shown below in TABLE XVIII. All processing solutions used in the method of this invention as practiced in this example were free of peracid bleaching accelerators and ferric ion complexes. The display material contained no bleaching accelerators.

TABLE XVIII

| DF | DBF |
|---|---|
| 1.734 | 0.008 |
| 1.742 | 0.000 |
| 1.778 | 0.018 |
| 1.742 | 0.003 |
| 1.755 | 0.013 |
| 1.710 | 0.001 |
| 1.621 | 0.006 |
| 1.550 | 0.010 |
| 1.441 | 0.001 |
| 1.271 | 0.006 |
| 1.086 | 0.000 |
| 0.884 | 0.000 |
| 0.663 | 0.000 |
| 0.403 | 0.018 |
| 0.227 | 0.003 |
| 0.095 | 0.008 |
| 0.037 | 0.008 |
| 0.014 | 0.001 |
| 0.010 | 0.000 |
| 0.005 | 0.001 |
| 0.003 | 0.003 |

EXAMPLE 17

This example shows that a periodate bleaching composition is as effective as a conventional chelated iron bleaching composition in bleaching silver developed in a color negative film (containing silver bromoiodide emulsions) processed in a conventional C-41 type process. All processing solutions used in the method of this invention as practiced in this example were free of peracid bleaching accelerators and ferric ion complexes.

Conventional FUJI SG 400 PLUS color negative film was exposed for 0.01 seconds on a 1B sensitometer (3000K) through a 0–4 step density chart and processed at 37.8° C. according to the following processing protocol:

| Solution | Time (min) DF | DBF-1 | DBF-2 |
|---|---|---|---|
| Color Developer B | 3.25 | 3.25 | 3.25 |
| Stop Bath A | 1 | 1 | 1 |
| Water wash | 1 | 1 | 1 |
| Bleach H | — | 3 | — |
| Color Film Bleaching Solution | — | — | 4 |
| Water wash | 7 | 4 | 3 |
| Fixing Solution C | 5 | 5 | 5 |
| Water wash | 3 | 3 | 3 |

Bleaching Composition H

| | |
|---|---|
| Sodium periodate | 64.2 grams |
| Sodium chloride | 11.7 grams |
| Sodium phosphate, monobasic, monohydrate | 69.0 grams |
| Phosphoric acid (85% in water) | 57.6 grams |
| Water to make | 1 liter |
| pH = 1.87 | |

The residual silver values are shown below in TABLE XIX.

TABLE XIX

| DF | DBF-1 | DBF-2 |
|---|---|---|
| 1.330 | 0.014 | 0.027 |
| 1.309 | 0.006 | 0.005 |
| 1.243 | 0.011 | 0.014 |
| 1.176 | 0.016 | 0.010 |
| 1.110 | 0.017 | 0.011 |
| 1.033 | 0.001 | 0.000 |
| 0.987 | 0.014 | 0.020 |
| 0.918 | 0.010 | 0.018 |
| 0.857 | 0.009 | 0.022 |
| 0.761 | 0.000 | 0.016 |
| 0.722 | 0.020 | 0.015 |
| 0.644 | 0.010 | 0.016 |
| 0.568 | 0.014 | 0.024 |
| 0.492 | 0.015 | 0.014 |
| 0.423 | 0.008 | 0.017 |
| 0.385 | 0.015 | 0.019 |
| 0.328 | 0.014 | 0.018 |
| 0.325 | 0.011 | 0.028 |
| 0.302 | 0.014 | 0.015 |
| 0.297 | 0.006 | 0.014 |
| 0.308 | 0.027 | 0.014 |

EXAMPLE 18

This example shows that a periodate bleaching solution can be silver-retentive even if the composition contains no halide. KODAK EDGE Color Paper was exposed as in Example 1 and processed according to the following processing protocol. All processing solutions used in the method of this invention as practiced in this example were free of peracid bleaching accelerators and ferric ion complexes. The KODAK EDGE Color Paper contained no bleaching accelerators.

| Solution | Time (min) DF | DBF | DB |
|---|---|---|---|
| Color Developer A | 1 | 1 | 1 |
| Water rinse* | — | — | — |

-continued

| | | | |
|---|---|---|---|
| Stop Bath A | 1 | 1 | 1 |
| Water wash | 1 | 1 | 1 |
| Bleach I | — | 2 | 2 |
| Water wash | 4 | 2 | 2 |
| Fixing Solution B | 3 | 3 | — |
| Water wash | 3 | 3 | 6 |

* Less than two seconds

Bleaching Composition I

| | |
|---|---|
| Sodium periodate | 42.8 grams |
| Sodium acetate, trihydrate | 15.8 grams |
| Glacial acetic acid | 8.05 grams |
| Water to make | 1 liter |
| pH = 4.5 | |

The residual silver values are shown below in TABLE XX.

TABLE XX

| DF | DBF | DB |
|---|---|---|
| 0.715 | 0.000 | 0.696 |
| 0.711 | 0.000 | 0.701 |
| 0.706 | 0.000 | 0.713 |
| 0.720 | 0.000 | 0.712 |
| 0.701 | 0.000 | 0.692 |
| 0.669 | 0.000 | 0.714 |
| 0.663 | 0.000 | 0.706 |
| 0.621 | 0.000 | 0.705 |
| 0.542 | 0.000 | 0.725 |
| 0.440 | 0.003 | 0.706 |
| 0.289 | 0.000 | 0.712 |
| 0.168 | 0.000 | 0.710 |
| 0.068 | 0.003 | 0.725 |
| 0.030 | 0.000 | 0.752 |
| 0.014 | 0.000 | 0.740 |
| 0.012 | 0.000 | 0.743 |
| 0.000 | 0.000 | 0.762 |
| 0.000 | 0.000 | 0.756 |
| 0.008 | 0.000 | 0.768 |
| 0.000 | 0.010 | 0.750 |
| 0.002 | 0.002 | 0.733 |

The invention has been described in detail with particular reference to preferred embodiments thereof, but it will be understood that variations and modifications can be effected within the spirit and scope of the invention.

We claim:

1. A photographic bleaching composition having a pH of less than 7, and consisting essentially of:

a) periodate, or a source for providing periodate, at a concentration of from about 0.01 to about 0.35 mol/l, and b) chloride ions at a concentration of at least 0.01 mol/l.

2. The composition of claim 1 wherein said periodate is an alkali metal periodate.

3. The composition of claim 1 wherein said periodate is present at from about 0.05 to about 0.2 mol/l, and chloride ions are present at from about 0.01 to about 1 mol/l.

4. The composition of claim 1 having a pH of from about 0.5 to about 5, and further includes a buffer or acid.

5. The composition of claim 1 wherein periodate is provided as a water-soluble salt of meta- or paraperiodic acid.

* * * * *